US010561208B2

(12) United States Patent
Cui et al.

(10) Patent No.: US 10,561,208 B2
(45) Date of Patent: Feb. 18, 2020

(54) WEARABLE PRODUCT BELT CONNECTION STRUCTURE

(71) Applicant: QINGDAO GOERTEK TECHNOLOGY CO., LTD., Qingdao (CN)

(72) Inventors: Zengsen Cui, Qingdao (CN); Long Yuan, Qingdao (CN); Yanyang Wang, Qingdao (CN)

(73) Assignee: QINGDAO GOERTEK TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 16/073,774

(22) PCT Filed: Dec. 31, 2016

(86) PCT No.: PCT/CN2016/114038

§ 371 (c)(1),
(2) Date: Jul. 28, 2018

(87) PCT Pub. No.: WO2017/197896

PCT Pub. Date: Nov. 23, 2017

(65) Prior Publication Data

US 2019/0029371 A1 Jan. 31, 2019

(30) Foreign Application Priority Data

May 19, 2016 (CN) ..... 2016 1 0340539

(51) Int. Cl.
*A44C 5/00* (2006.01)
*A44C 5/20* (2006.01)
(Continued)

(52) U.S. Cl.
CPC ..... *A44C 5/0007* (2013.01); *A44C 5/2071* (2013.01); *A41F 1/008* (2013.01);
(Continued)

(58) Field of Classification Search
CPC ... A44C 5/2057; A44C 5/2061; A44C 5/2071; A44C 5/02; A44C 5/22; A44C 5/246;
(Continued)

(56) References Cited

U.S. PATENT DOCUMENTS 7,707,695 B2 * 5/2010 Dubois ..... A42B 3/145 2/418
2008/0109947 A1 5/2008 Dubois

FOREIGN PATENT DOCUMENTS

CN 2636650 Y 9/2004
CN 2636650 Y 9/2004
(Continued)

OTHER PUBLICATIONS

First Office Action dated Jan. 26, 2017 for Application No. 201610340539.

(Continued)

*Primary Examiner* — Jack W Lavinder
(74) *Attorney, Agent, or Firm* — Moser Taboada

(57) ABSTRACT

A belt connection structure of a wearable product is provided. A first transmission rack is provided on a side wall of a first elongate hole. A second transmission rack is provided on a side wall of a second elongate hole facing the first transmission rack. A gear is engaged with the first and second transmission racks respectively. A connecting member coaxial with the gear is provided on a side surface of the gear. A sleeve communicating with a slide way is provided on the outer side wall of an outer cover. The inner side wall of the sleeve is provided with teeth extending in the axial direction. At least two annular grooves are formed on the outer side wall of the sleeve. A belt button is mounted on the sleeve, and comprises a pressing portion and a connecting column. The pressing portion and the connecting column are slidable in the axial direction but are not rotatable relative to each other. Position limiting teeth are provided on the outer
(Continued)

side surface of the connecting column. The circumferential surface of the connecting column is further provided with a snap-fit flange spaced from the connecting column. The snap-fit flange is engaged with an annular groove.

5 Claims, 2 Drawing Sheets

(51) Int. Cl.

| | |
|---|---|
| *A44B 11/12* | (2006.01) |
| *A43C 11/14* | (2006.01) |
| *A41F 1/00* | (2006.01) |
| *A44C 5/24* | (2006.01) |

(52) U.S. Cl.
CPC ..... *A43C 11/14* (2013.01); *A44B 11/125* (2013.01); *A44C 5/246* (2013.01)

(58) Field of Classification Search
CPC .. A41F 1/008; Y10T 24/2187; Y10T 24/1431; Y10T 24/1427; Y10T 74/18816; A61F 9/06; A42B 3/145; A42B 3/324
USPC ..... 2/418; 24/19, 269, 68 R, 71.1, 68 J, 24/68 DSK, 68 B
See application file for complete search history.

(56) References Cited

FOREIGN PATENT DOCUMENTS

| | | | |
|---|---|---|---|
| CN | 201204973 | Y | 3/2009 |
| CN | 201204973 | Y | 3/2009 |
| CN | 102245042 | A | 11/2011 |
| CN | 102245042 | A | 11/2011 |
| CN | 203801842 | U | 9/2014 |
| CN | 204015341 | U | 12/2014 |
| CN | 204015341 | U | 12/2014 |
| CN | 105156924 | A | 12/2015 |
| CN | 204969664 | U | 1/2016 |
| CN | 204969664 | U | 1/2016 |
| CN | 204989649 | U | 1/2016 |
| CN | 205234925 | U | 5/2016 |
| CN | 105815895 | A | 8/2016 |
| CN | 205757644 | U | 12/2016 |
| EP | 2095729 | | 9/2009 |
| EP | 2095729 | A1 | 9/2009 |
| GB | 201207616 | A | 5/2012 |
| GB | 2497371 | A | 6/2013 |
| JP | H-07293515 | A | 11/1995 |
| WO | WO-2011141061 | A1 | 11/2011 |

OTHER PUBLICATIONS

Second Office Action dated Sep. 14, 2017 for Application No. 201610340539.
Third Office Action dated Mar. 12, 2018 for Application No. 201610340539.
Chinese First Office Action dated Jan. 26, 2017 for Application No. 201610340539.0.
International Search Report dated Feb. 24, 2017 for PCT Application No. PCT/CN2016/114038.
Chinese Second Office Action dated Sep. 14, 2017 for Application No. 201610340539.0.
Chinese Third Office Action dated Mar. 12, 2018 for Application No. 201610340539.0.

* cited by examiner

WEARABLE PRODUCT BELT CONNECTION STRUCTURE

CROSS REFERENCE TO RELATED APPLICATIONS

This application is a U.S. National Stage entry under 35 U.S.C. § 371 based on International Application No. PCT/CN2016/114038, filed on Dec. 31, 2016, which was published under PCT Article 21(2) and which claims priority to Chinese Patent Application No. 201610340539.0, filed on May 19, 2016. The disclosure of the priority applications are hereby incorporated herein in their entirety by reference.

TECHNICAL FIELD

The present disclosure belongs to the technical field of wearable products, and particularly relates to a belt connection structure of a wearable product.

BACKGROUND

More and more wearable products, such as smart wristbands, smart wristwatches and virtual reality devices, have entered people's daily lives. The tightness adjustment structure of the belts of these wearable products is complicated, its operation is troublesome and time-consuming, and it cannot achieve continuous adjustment, which make the use of wearable products very inconvenient.

SUMMARY

An object of the present disclosure is to provide a belt connection structure of a wearable product that can achieve continuous adjustment of length, so as to solve the problem that the operation of adjusting the belt length of the wearable product is troublesome and time-consuming and make the use of wearable products easy and convenient.

To achieve the above object, the technical solutions of the present disclosure are as follows.

A belt connection structure of a wearable product comprising an inner cover, an outer cover, a first belt, a second belt, a gear and a belt button, wherein the inner cover and the outer cover are clamped together, and a slide way is formed between the inner cover and the outer cover;

the first belt and the second belt are inserted from two ends of the slide way and overlapped, a first elongate hole is provided along a length direction of the first belt at a position of the first belt that is corresponding to the slide way, a first transmission rack is provided on a side wall of the first elongate hole, a second elongate hole is provided along a length direction of the second belt at a position of the second belt that is corresponding to the slide way, and a second transmission rack is provided on a side wall of the second elongate hole which faces the first transmission rack;

the gear is engaged with the first transmission rack and the second transmission rack and is rotatably connected with the side wall of the slide way, a coaxial connecting member is provided on the side surface of the gear, a sleeve communicating with the slide way is provided on an outer side wall of the outer cover, the inner side wall of the sleeve is provided with teeth extending in the axial direction, and at least two annular grooves are on the outer side wall of the sleeve; and the belt button is mounted on the sleeve and comprises a pressing portion and a connecting column whose one end is fixedly connected with the pressing portion and other end is connected with the connecting member, the connecting column and the connecting member are slidable in the axial direction but are not rotatable relative to each other, an outer side surface of the connecting column is provided with position limiting teeth extending in an axial direction, a snap-fit flange is provided in a circumferential surface of the connecting column, and the snap-fit flange is spaced from the connecting column and is engaged with an annular groove.

In some embodiments, the annular groove is two annular grooves, a blocking flange is provided at the end of the sleeve that is further away from the outer cover, a position limiting flange is provided between the blocking flange and the outer cover, and an annular groove is formed between the blocking flange and the position limiting flange, and between the position limiting flange and the outer cover, respectively.

In some embodiments, an end of the connecting column that is further away from the pressing portion is provided with a prismatic axial hole, the connecting member is a prism and is inserted into the axial hole, and a circumscribed circle diameter of the prism is greater than an inscribed circle diameter of the prismatic axial hole.

In some embodiments, the connecting column is of a prismatic shape, the connecting member is a tube having a prismatic axial hole, the end of the connecting column is inserted into the axial hole of the tube, and a circumscribed circle diameter of the prism is greater than an inscribed circle diameter of the prismatic axial hole.

In some embodiments, a cylindrical connecting wall is provided at an outer periphery of the connecting column, one end of the connecting wall is connected to the pressing portion, and the snap-fit flange is disposed on the inner side wall of the other end of the connecting wall.

In some embodiments, snap-fit, flange comprises a plurality of spaced flange units provided circumferentially on the inner side wall of the connecting wall.

In some embodiments, the inner cover is groove-shaped, shaft is provided between the two groove walls at a position corresponding to the gear, and the gear is sleeved on the shaft and is rotatable relative to each other; and the outer cover is plate-shaped, and clamped between the groove walls of the inner cover.

By using the above technical solution, when the length of the connected belt is required to be adjusted, the pressing portion is pulled outwards to disengage the position limiting teeth on the outer side surface of the connecting column from the teeth on the inner side wall of the sleeve, and the connecting column and the connecting member are slidable in the axial direction but are not rotatable relative to each other. When the pressing portion is pulled out, the connecting column and the connecting member will not be separated. Then the pressing portion is rotated, the rotational power is transmitted to the gear via the connecting column and the connecting member. The first transmission rack provided on the side wall of the first elongate hole and the second transmission rack provided on the side wall of the second elongate hole facing the first transmission rack are both engaged with the gear, so the rotational power is transmitted to the first belt and the second belt via the gear. The first belt and the second belt are moved toward or away from each other to achieve the adjustment of the belt length. Since the adjustment is made through gear engagement, continuous adjustment can be achieved.

When the adjustment is completed, the pressing portion of the belt button is pressed, and the snap-fit flange abuts in the annular groove near the outer cover, so that the position limiting teeth on the outer side surface of the connecting column engage with the teeth on the inner side wall of the sleeve and they are not rotatable relative to each other. Thus, the belt button will not rotate, and the belt length is fixed.

The belt connection structure of a wearable product according to the embodiment of the present disclosure can achieve continuous adjustment of the length, solve the problem that the operation of adjusting the belt length of the wearable product is troublesome and time-consuming, and make the use of wearable products easy and convenient.

BRIEF DESCRIPTION OF DRAWINGS

The present disclosure will hereinafter be described in conjunction with the following drawing figures, wherein like numerals denote like elements, and.

Figure 1:
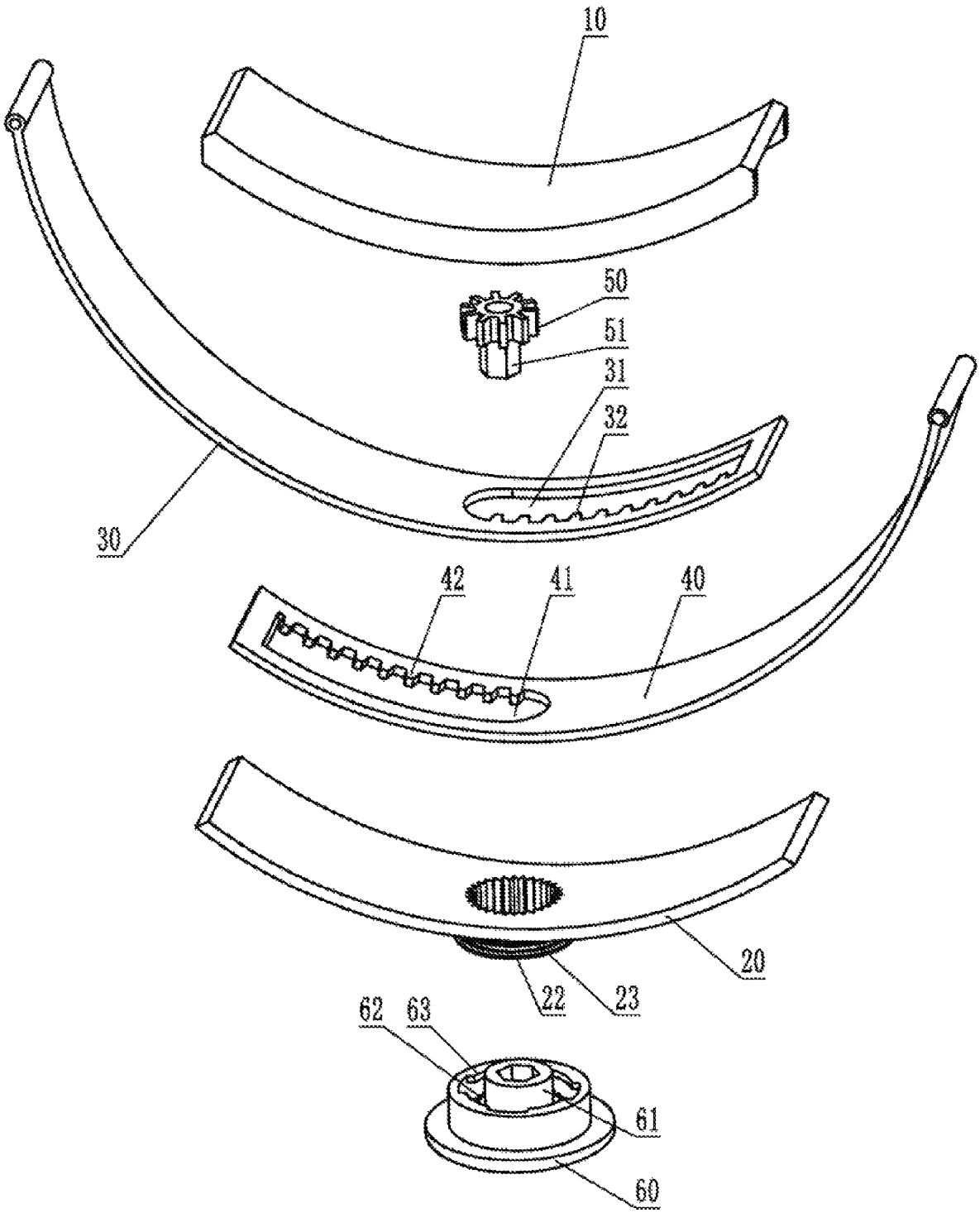
FIG. 1 is a schematic exploded view of the structure of the belt connection structure of a wearable product according to an embodiment of the present disclosure.

In the drawings, 10: inner cover, 11: shaft, 20: outer cover, 21: sleeve, 22: blocking flange, 23: position limiting flange, 30: first belt, 31: first elongate hole, 32: first transmission rack, 40: second belt, 41: second elongate hole, 42: second transmission rack, 50: gear, 51 connecting member, 60: belt button, 61 connecting column, 62: position limiting teeth, 63: snap-fit flange.

DETAILED DESCRIPTION

In order to make the objectives, technical solutions and advantages of the present disclosure clearer, the present disclosure is further described in detail with reference to the accompanying drawings and the embodiments. It should be understood that the specific embodiments described herein are only used to explain the present disclosure and are not intended to limit the present disclosure.

Figure 2:
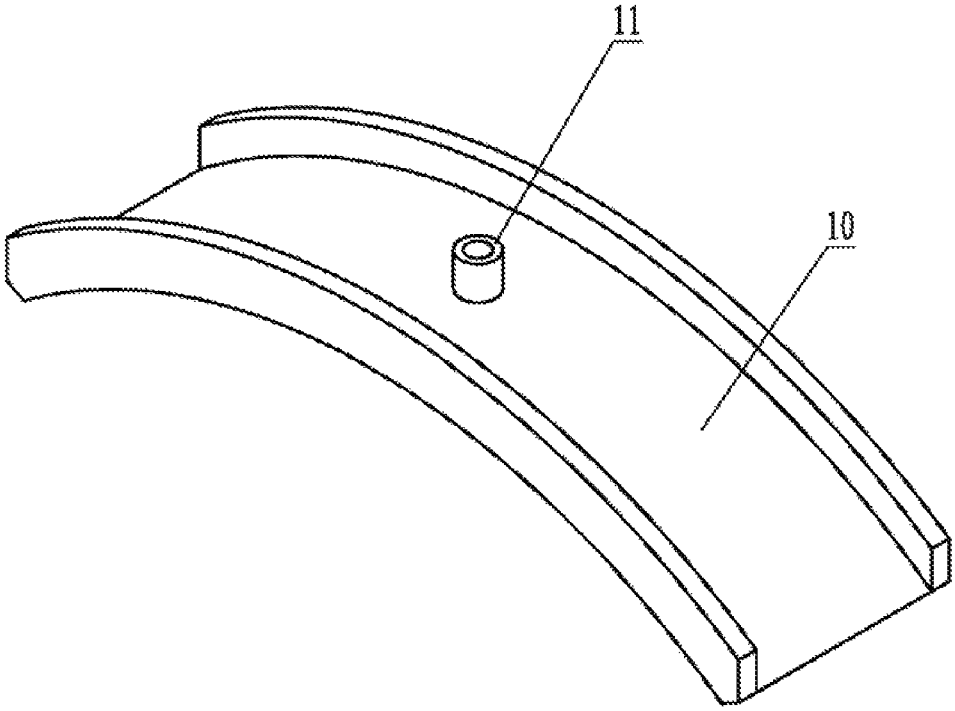
FIG. 2 is a schematic view of the structure of an inner cover of the belt connection structure of a wearable product according to an embodiment of the present disclosure.
Figure 3:
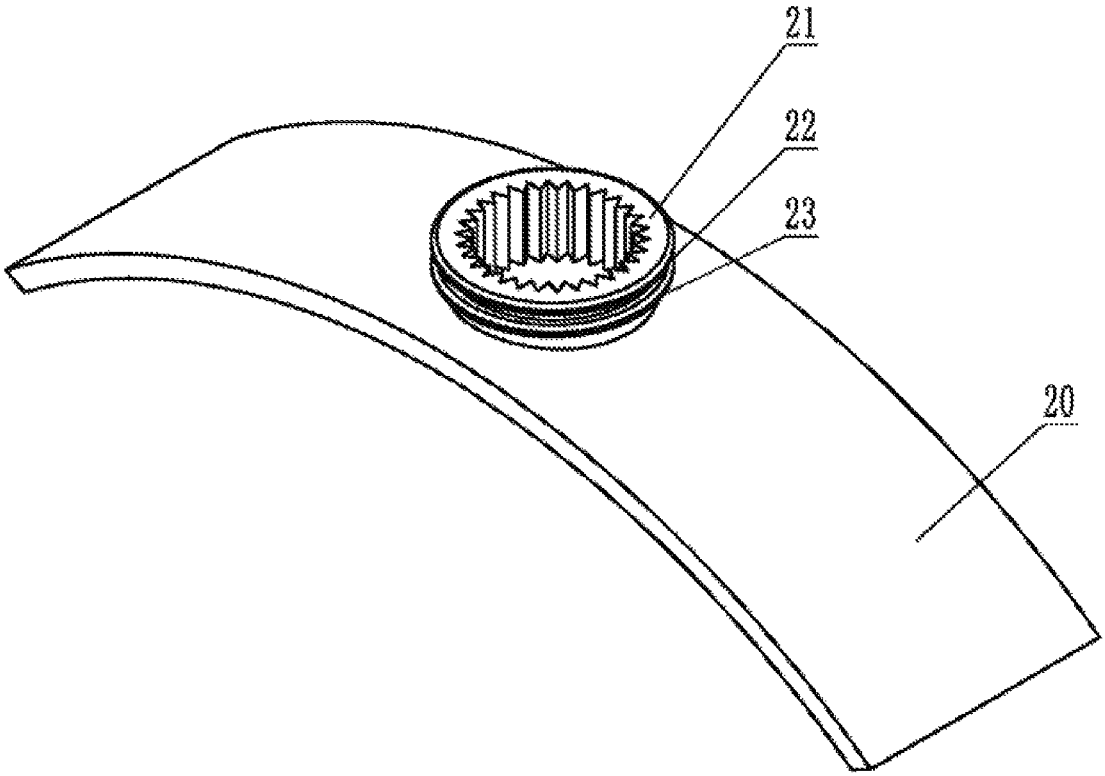
FIG. 3 is a schematic view of the structure of an outer cover of the belt connection structure of a wearable product according to an embodiment of the present disclosure.

Herein, when the wearable product is worn, the side closer to the user is defined as the inner side, and the side further away from the user is defined as the outer side. As can be seen from FIG. 1, FIG. 2 and FIG. 3, the belt connection structure of a wearable product comprises: an inner cover 10, an outer cover 20, a first belt 30, a second belt 40, a gear 50 and a belt button 60.

The inner cover 10 and the outer cover 20 are clamped together. A slide way is formed between the inner cover 10 and the outer cover 20.

The first belt 30 and the second belt 40 are respectively inserted from two ends of the slide way and overlapped. A first elongate hole 31 is provided along the length direction of the first belt 30 at a position of the first belt 30 that is corresponding to the slide way. A first transmission rack 32 is provided on a side wall of the first elongate hole 31. A second elongate hole 41 is provided along the length direction of the second belt 40 at a position of the second belt 40 that is corresponding to the slide way. A second transmission rack 42 is provided on a side wall of the second elongate hole 41 which faces the first transmission rack 32.

The gear 50 is engaged with the first transmission rack 32 and the second transmission rack 42 respectively, and is rotatably connected with the side wall of the slide way. A coaxial connecting member 51 is provided on the side surface of the gear 50. A sleeve 21 communicating with the slide way is provided on the outer side wall of the outer cover 20. The inner side wall of the sleeve 21 is provided with teeth extending in the axial direction, and at least two annular grooves are on the outer side wall of the sleeve 21.

The belt button 60 is mounted on the sleeve 21, and comprises a pressing portion and a connecting column 61 fixedly connected with the pressing portion. The connecting column 61 and the connecting member 51 are slidable in the axial direction but are not rotatable relative to each other. The connecting column 61 is provided with position limiting teeth 62 extending along its axial direction on its outer side surface. A snap-fit flange 63 is spaced from the connecting column 61 and is engaged with an annular groove.

When the length of the connected belt is required to be adjusted, the pressing portion is pulled outwards to disengage the position limiting teeth 62 on the outer side surface of the connecting column 61 from the teeth on the inner side wall of the sleeve 21, and the connecting column 61 and the connecting member 51 are slidable in the axial direction but are not rotatable relative to each other. When the pressing portion is pulled out, the connecting column 61 and the connecting member 51 will not be separated. Then the pressing portion is rotated, the rotational power is transmitted to the gear 50 via the connecting column 61 and the connecting member 51. The first transmission rack 32 provided on the side wall of the first elongate hole 31 and the second transmission rack 42 provided on the side wall of the second elongate hole 41 facing the first transmission rack 32 are both engaged with the gear 50, so the rotational power is transmitted to the first belt 30 and the second belt 40 via the gear 50. The first belt 30 and the second belt 40 are moved toward or away from each other to achieve the adjustment of the belt length. Since the adjustment is made through gear engagement, continuous adjustment can be achieved.

When the adjustment is completed, the pressing portion of the belt button 60 is pressed, and the snap-fit flange 63 abuts in the annular groove near the outer cover 20, so that the position limiting teeth 62 on the outer side surface of the connecting column 61 engage with the teeth on the inner side wall of the sleeve 21 and they are not rotatable relative to each other. Thus, the belt button 60 will not rotate, and the belt length is fixed.

The belt connection structure of a wearable product according to the embodiment of the present disclosure can achieve continuous adjustment of the length, solve the problem that the operation of adjusting the belt length of the wearable product is troublesome and time-consuming, and make the use of wearable products easy and convenient.

In some embodiments, the inner cover 10 is groove-shaped, and a shaft 11 is provided between the two groove walls at a position corresponding to the gear 50. The gear 50 is sleeved on the shaft 11 and is rotatable relative to each other. The outer cover 20 is plate-shaped, and clamped between the groove walls of the inner cover 10.

In some embodiments, typically the annular groove is two annular grooves, a blocking flange 22 is provided at the end of the sleeve 21 that is further away from the outer cover 20, and a position limiting flange 23 is further provided between the blocking flange 22 and the outer cover 20. An annular groove is formed between the blocking flange 22 and the position limiting flange 23, and between the position limiting flange 23 and the outer cover 20, respectively.

In some embodiments, the end of the connecting column 61 that is further away from the pressing portion is provided with a prismatic axial hole. The connecting member 51 is a prism and is inserted into the axial hole. The circumscribed circle diameter of the prism is greater than the inscribed circle diameter of the prismatic axial hole, to avoid relative rotation between them.

Of course, the connecting column 61 may also be of a prismatic shape, and the connecting member 51 is a straight tube having a prismatic axial hole. The end of the connecting column 61 is inserted into the axial hole of the straight tube. The circumscribed circle diameter of the prism is greater than the inscribed circle diameter of the prismatic axial hole.

In some embodiments, a cylindrical connecting wall is provided at an outer periphery of the connecting column 61. One end of the connecting wall is connected to the pressing portion, and the snap-fit flange 63 is disposed on the inner side wall of the other end of the connecting wall. In the present embodiment, the snap-fit flange 63 comprises a plurality of spaced flange units provided circumferentially on the inner side wall of the connecting wall.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

The invention claimed is:

1. A belt connection structure of a wearable product comprising an inner cover, an outer cover, a first belt, a second belt, a gear and a belt button, wherein the inner cover and the outer cover are clamped together, and a slide way is formed between the inner cover and the outer cover;

the first belt and the second belt are inserted from two ends of the slide way and overlapped, a first elongate hole is provided along a length direction of the first belt at a position of the first belt that is corresponding to the slide way, a first transmission rack is provided on a side wall of the first elongate hole, a second elongate hole is provided along a length direction of the second belt at a position of the second belt that is corresponding to the slide way, and a second transmission rack is provided on a side wall of the second elongate hole which faces the first transmission rack;

the gear is engaged with the first transmission rack and the second transmission rack and is rotatably connected with the side wall of the slide way, a coaxial connecting member is provided on the side surface of the gear, a sleeve communicating with the slide way is provided on an outer side wall of the outer cover, an inner side wall of the sleeve is provided with teeth extending in the axial direction, and at least two annular grooves are on an outer side wall of the sleeve; and the belt button is mounted on the sleeve and comprises a pressing portion and a connecting column whose one end is fixedly connected with the pressing portion and other end is connected with the connecting member, the connecting column and the connecting member are slidable in the axial direction but are not rotatable relative to each other, an outer side surface of the connecting column is provided with position limiting teeth extending in an axial direction, a snap-fit flange is spaced from the connecting column and is engaged with one of the annular grooves;

a cylindrical connecting wall is provided at an outer periphery of the connecting column, one end of the cylindrical connecting wall is connected to the pressing portion, and the snap-fit flange is disposed on an inner sidewall of the other end of the cylindrical connecting wall;

a blocking flange provided at the end of the sleeve that is further away from the outer cover, a position limiting flange provided between the blocking flange and the outer cover, and a first of the at least two annular grooves formed between the blocking flange and the position limiting flange, and a second of the at least two annular grooves formed between the position limiting flange and the outer cover;

wherein the snap-fit flange comprises a plurality of spaced flange units provided circumferentially on the inner sidewall of the cylindrical connecting wall.

2. The belt connection structure of a wearable product according to claim 1, wherein an end of the connecting column that is further away from the pressing portion is provided with a prismatic axial hole, the connecting member is a prism and is inserted into the axial hole, and a circumscribed circle diameter of the prism is greater than an inscribed circle diameter of the prismatic axial hole, to avoid relative rotation between the connecting member and the connecting column.

3. The belt connection structure of a wearable product according to claim 1, wherein the connecting column is of a prismatic shape, the connecting member is a tube having a prismatic axial hole, the end of the connecting column is inserted into the axial hole of the tube, and a circumscribed circle diameter of the prism is greater than an inscribed circle diameter of the prismatic axial hole, to avoid relative rotation between the connecting member and the connecting column.

4. The belt connection structure of a wearable product according to claim 1, wherein the inner cover is groove-shaped, a rotating shaft is provided between the two groove walls at a position corresponding to the gear, and the gear is sleeved on the rotating shaft and is rotatable relative to each other; and the outer cover is plate-shaped, and clamped between the groove walls of the inner cover.

5. The belt connection structure of a wearable product according to claim 1, wherein the cylindrical connecting wall has a continuous annular shape.

* * * * *